United States Patent [19]

Lang et al.

[11] 4,192,272

[45] Mar. 11, 1980

[54] CONTROL DEVICE FOR FUEL-INJECTED INTERNAL COMBUSTION ENGINES

[75] Inventors: Thomas Lang, Schwäbisch Hall; Karl-Heinz Zoske, Stuttgart, both of Fed. Rep. of Germany

[73] Assignee: Robert Bosch GmbH, Stuttgart, Fed. Rep. of Germany

[21] Appl. No.: 905,612

[22] Filed: May 12, 1978

[30] Foreign Application Priority Data

Jun. 7, 1977 [DE] Fed. Rep. of Germany ..... 7717931

[51] Int. Cl.[2] ..... F02D 1/04; F02B 77/00

[52] U.S. Cl. ..... 123/140 MC; 123/140 R; 123/198 D

[58] Field of Search ..... 123/140 R, 140 MC, 198 D

[56] References Cited

U.S. PATENT DOCUMENTS 3,362,387 1/1968 Neumann ..... 123/140

4,085,724 4/1978 Djordjevic ..... 123/140 MC

FOREIGN PATENT DOCUMENTS 1242049 5/1967 Fed. Rep. of Germany ..... 123/198 D

*Primary Examiner*—Ira S. Lazarus

*Assistant Examiner*—Carl Stuart Miller

*Attorney, Agent, or Firm*—Edwin E. Greigg

[57] ABSTRACT

A control device for the fuel supply system of a fuel-injected internal combustion engine provided with a correcting device, which changes the adjusting path and/or the full load position of the fuel quantity adjusting member of the fuel metering device in dependence on operational values the operation of which is made visible by means of a signal indicator. The adjusting member of the correcting device is provided with opposed walls either of which is arranged to cooperate with a stop which is connected to the electrical circuit of the signal indicator, with the stop being mounted in the governor housing in such a manner that it is electrically insulated therefrom.

7 Claims, 2 Drawing Figures

CONTROL DEVICE FOR FUEL-INJECTED INTERNAL COMBUSTION ENGINES

BACKGROUND OF THE INVENTION

The invention relates to a control device for the fuel supply of a fuel-injected internal combustion engine having a correcting device which changes the adjusting path and/or the full load position of the delivery quantity adjusting member of the fuel metering device in dependence on operation values and in which the adjusting member abuts a stop that is built into the housing at least in its original position.

Known control devices of this type operate in dependence on surrounding air pressure; manifold air pressure in the induction line of the internal combustion engine; the internal combustion engine temperature or other operational values that influence the performance of the internal combustion engine and the corresponding fuel metering. In these known devices, the linkage of the governor engages the adjusting member of the correcting device in order to alter the governor's characteristic curve in accordance with changing operating conditions. Other of these known devices limit the allowable full load position of the delivery quantity adjusting member, acting as a full load stop. The basic calibration of these devices is very expensive and when the housing is closed, it is either impossible or very expensive to verify that the correcting device is functioning properly, and this can be done only with the added expense of removing the pump from beneath the hood of a motor vehicle.

Thus, in one known control device (DT-OS No. 25 26 148), several criteria must be coordinated with each other and maintained in proper setting during mounting or adjustment of the device which includes a correcting device that alters the transfer characteristics of the control rod and engages the governor linkage by means of an activating rod and a cam plate that serves as an adjusting member. This is true because the cam plate lies inside the governor housing and its position can only be adjusted indirectly. This setting process is expensive, easily leads to incorrect settings, and when structural elements or operational play of the internal combustion engine change, the position of the cam plate also changes in an uncontrollable manner.

OBJECT AND SUMMARY OF THE INVENTION

The control device according to the invention has the advantage that when the correcting device is mounted, the original position of the adjusting member can be controlled and adjusted at any time, for example by means of a simple, exteriorly mounted adjusting screw. In addition to this simplified setting process, it is also possible to adjust the control device while the engine is in operation or during an engine inspection.

A further advantage of the invention is that the adjusting member assumes the configuration of a cam plate having a notched area and opposed side wall surfaces with said side wall surfaces providing the limit of oscillatory movement of said cam plate.

A still further advantage of the invention is that the cam plate and the stop with which it cooperates are arranged in an electrical circuit so that precise adjustments can be made on the control device without disassembling it from the motor vehicle engine.

Still another advantage of the invention is that the pump housing is provided with a threaded aperture into which is secured a bushing that insulatively supports the stop for the cam plate with the bushing and the stop including electroconductive means arranged for actuation of a signal lamp.

The invention will be better understood as well as further objects and advantages thereof become more apparent from the ensuing detailed description of preferred embodiments taken in conjunction with the drawings.

DESCRIPTION OF THE PREFERRED EMBODIMENT

Figure 1:
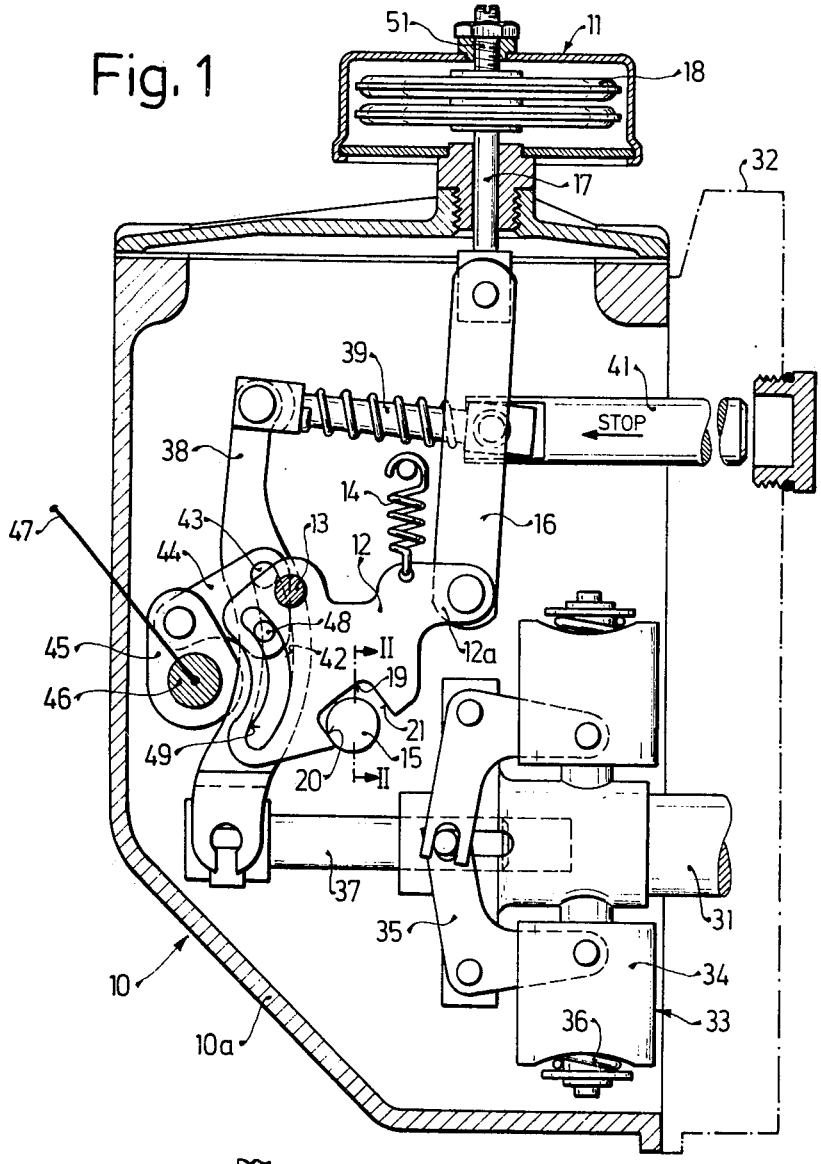
FIG. 1 is a cross-sectional view through the housing of a centrifugal rpm governor with the control device according to the invention shown in elevation.

In the exemplary embodiment shown in the drawings the control device according to the invention is built into a housing 10*a* of a centrifugal rpm governor 10, and basically comprises a correcting device 11 that operates in dependence on barometric air pressure and cam plate 12, which is activated thereby and serves as an adjusting member. The cam plate 12 has, as an axis of rotation, a shaft 13 which is attached to the governor housing 10*a* and is held in its starting position against a stop 15 by a return spring 14. A lever extension 12*a* of the cam plate 12 is connected with a pressure pin 17 of the correcting device 11 by means of a tab 16. The correcting device 11 contains diaphragm cells 18 in a known manner, which expand under the prevailing low air pressure and thus rotate the cam plate 12 clockwise by means of the pressure pin 17 and the tab 16. By this means, as is described in greater detail below, when the setting member of the governor is in its full load position, a correction of the quantity of fuel delivered by the injection pump takes place.

The cam plate 12 is provided with a U-shaped recess or notched area 19, one side wall surface 20 of which abuts the stop 15 as in the position shown, and the other side wall surface 21 of which rests against the stop 15 when the diaphragm cells 18 of the correcting device 11 have transferred the greatest possible adjusting path to the cam plate 12.

The stop 15 comprises a stop bolt made of electroconductive material, the end portion 15*a* of which, in the shape of a cylinder head, projects into the interior of the governor housing 10*a* and has an outer diameter *d*. By exchanging the stop bolt 15 with one having a different outer diameter *d* the maximum rotational path of the cam plate 12, which is determined by the arrangement of the side wall surfaces 20 and 21 of the recess 19 with respect to the stop bolt 15, can be adjusted as desired. This exchange of the stop bolt 15 is simplified by the fact that it is mounted in a threaded bushing 22, which is screwed into the housing 10*a* in such a manner that the stop bolt is electrically insulated. The hollow rivet-like end 15*b* of the stop bolt 15, which has a longitudinal bore and is located opposite the head-shaped end 15*a*, serves to receive a slidable plug element 23, which is shown by dot-and-dash lines and in this manner is adapted to connect the stop bolt 15 with an electrical circuit 24 of a signal indicator 25. A connecting lug 26 that is soldered to the threaded bushing 22 forms a ground. Of course, the ground connection can be attached at any other desired point on the governor or pump housing. The stop bolt 15 is insulated from the threaded bushing 22 by an insulative sleeve-like element 27, so that no metallic contact is possible between these elements. In the illustrated embodiment the insulative sleeve element 27 comprises a bushing and two disc members, but this sleeve element can also be formed by injecting an insulating material into the bore provided in the threaded bushing 22. A small electric light 25 is shown as the signal indicator, and this can be located either on the instrument panel of the associated motor vehicle or on the control panel of the engine, or even on a testing device so as to be easily visible to personnel servicing the equipment. Of course, a glimmer lamp such as that used in determining the timing of the ignition of a motor vehicle can also be used.

The embodiment of the control device according to the invention is shown in the drawing as a cam plate 12, which serves as an adjusting member and is located inside the governor housing 10*a*, and together with the stop 15 it forms a contact switch for the signal indicator 25. The stop bolt 15, which according to the invention is insulated from the housing 10*a*, can, of course, be used in any desired correcting device, which would carry out an adjusting path for correcting the quantity of fuel delivered by the injection pump.

OPERATION

At this time the structure and the method of operation of the centrifugal rpm governor 10 shown in FIG. 1 will be described.

The centrifugal rpm governor 10 has already been made known by a German patent application (DT-OS No. 25 26 148) filed by the assignee of this application and has a fly weight governor 33, which is mounted on the drive shaft 31 of an injection pump 32 that serves to meter the fuel delivery, with the pump 32 being shown only by broken lines. The governor 33 has flyweights 34, which shift a control sleeve 37 by means of bell crank levers 35 during their regulating movement that takes place against the force of regulating springs 36. The control sleeve 37 is connected with the fuel quantity control rod 41 of the injection pump 32 that serves as the fuel delivery quantity adjusting member by means of an elongated lever 38 and a link 39 that serves as a force reservoir. The elongated lever 38 has a curved slot 42 which is engaged by a protuberance 43, which serves as a mounting, i.e., rotational point, and is attached to a coupling element 44 of a link member 45. The link member 45 can be rotated by means of a shaft 46 that is mounted in the governor housing 10*a* and provided with an adjusting lever 47 attached to the lever shaft 46. A second protuberance 48 is attached to the protuberance 43 on the coupling member element 44 that is connected with the link member 45, with the second protuberance being guided in a curved track 49 of the cam plate 12. When the cam plate 12 is rotated around the shaft 13, this protuberance 48, when in the full load position of the adjusting lever 47 shown here, controls a corrected position of the fuel quantity control rod 41 as opposed to the original movement of this regulating rod 41.

Figure 2:
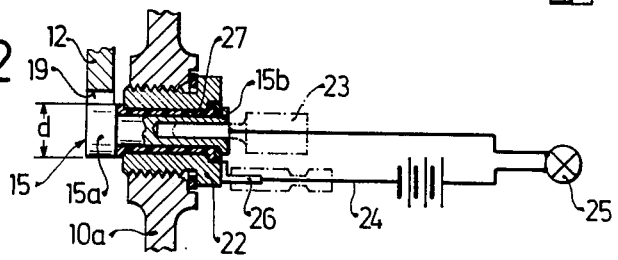
FIG. 2 is a fragmentary sectional view along the line II—II in FIG. 1 through the insulated stop bolt.

When the electrical circuit 24 of the signal indicator 25 is connected as shown in FIG. 2, and when the side wall surface 20 of the recess 19 of the cam plate 12 abuts the head-shaped end 15*a* of the stop bolt 15 (as shown in FIG. 1), the signal indicator 25, which is formed as a glow lamp, is illuminated, and it goes out again when the cam plate 12 is rotated clockwise by the correcting device 11 and the connection between the side wall surface 20 and the stop bolt 15 is interrupted. However, it is again illuminated when the other side wall surface 21 of the recess 19 comes into contact with the end 15*a* of the stop bolt 15. In this manner the characteristic curve of the correcting device 11 and the point of engagement for the beginning of the adjusting movement of the correcting device 11 can be adjusted very precisely. This type of adjustment can, for example, take place by rotating an adjusting screw 51 that is arranged on the correcting device 11. Even a change or shift in the installed position of the diaphragm cells 18 or an enlargement of the coupling play in the connecting points between the pressure pin 17 and the tab 16 or the tab 16 and the cam plate 12 will be indicated by an untimely extinguishing of the glow lamp 25.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A control device for the fuel supply system of a fuel-injected internal combustion engine including a fuel metering device having a movable fuel quantity adjusting member, a housing, a stop supported on said housing, a correcting device which changes the adjusting path and/or the full-load position of said fuel quantity adjusting member of said fuel metering device in dependence on operation values, said fuel quantity adjusting member being arranged to be moved into abutting engagement with said stop, an electrical circuit including a signal indicator, means for connecting said stop and said adjusting member to said electrical circuit upon said abutting engagement of said adjusting member with said stop, said stop being provided with insulative means to prevent the grounding of said stop to said housing, said stop being capable of conducting current through said electrical circuit upon said abutting engagement of said stop by said adjusting member to energize said signal indicator.

2. A control device for the fuel supply system of a fuel-injected internal combustion engine as claimed in claim 1, wherein said adjusting member is provided with a notched area having opposed side walls each of which walls are arranged to cooperate with said stop.

3. A control device for the fuel supply system of a fuel-injected internal combustion engine as claimed in claim 2, wherein said stop includes a hollow area arranged to receive a means to accommodate an electrical connection.

4. A control device for the fuel supply system of a fuel-injected internal combustion engine as claimed in claim 3, wherein said stop includes a headed portion having a diameter *d*, said headed portion predetermining the path of travel of said adjusting member.

5. A control device for the fuel supply system of a fuel-injected internal combustion engine as claimed in claim 1, wherein said stop is mounted in a threaded bushing element supported in said housing and further that said stop is electrically insulated from said housing.

6. A control device for the fuel supply system of a fuel-injected internal combustion engine as claimed in claim 3, wherein said stop is mounted in a bushing and is electrically insulated from said housing.

7. A control device for the fuel supply system of a fuel-injected internal combustion engine as claimed in claim 6, wherein said bushing is threadedly supported in said housing.

* * * * *